United States Patent [19]

Strauss

[11] 4,357,731

[45] Nov. 9, 1982

[54] DOOR CLOSER WITH HOLD OPEN FEATURE

[75] Inventor: Leopold Strauss, East Rockaway, N.Y.

[73] Assignee: Leigh Products, Inc., Grand Rapids, Mich.

[21] Appl. No.: 113,102

[22] Filed: Jan. 17, 1980

[51] Int. Cl.[3] ..... E05F 3/02; E05F 3/22

[52] U.S. Cl. ..... 16/70

[58] Field of Search ..... 16/49, 65, 66, 70, 82, 16/DIG. 10, DIG. 17

[56] References Cited

U.S. PATENT DOCUMENTS

| | | | |
|---|---|---|---|
| 2,261,652 | 11/1941 | LaMere | 16/66 X |
| 2,880,029 | 3/1959 | Allen | 16/82 X |
| 3,000,044 | 9/1961 | Allen et al. | 16/82 |
| 3,538,537 | 11/1970 | Strauss | 16/66 |
| 3,601,842 | 8/1971 | Morrison et al. | 16/49 |
| 3,630,560 | 12/1971 | Atkins et al. | 16/49 X |
| 3,785,004 | 1/1974 | Stoffregen | 16/49 |
| 4,048,695 | 9/1977 | Julifs et al. | 16/65 |

FOREIGN PATENT DOCUMENTS

| | | | |
|---|---|---|---|
| 226413 | 10/1909 | Fed. Rep. of Germany | 16/DIG. 17 |
| 2422596 | 2/1975 | Fed. Rep. of Germany | 16/82 |
| 1347891 | 11/1963 | France | 16/82 |
| 17713 | of 1897 | United Kingdom | 16/49 |

*Primary Examiner*—W. Carter Reynolds
*Attorney, Agent, or Firm*—Robert H. Montgomery

[57] ABSTRACT

A dashpot type door closer having an internal mechanism which will latch the door in an open position when the door is opened a sufficient distance, and which will release the door from a latched open position when the door is moved slightly more in the opening direction. A piston rod having a latching member extends through the internal mechanism and the latching member is pivoted between latched and unlatched positions by the internal mechanism.

8 Claims, 13 Drawing Figures

DOOR CLOSER WITH HOLD OPEN FEATURE

This invention relates to door closers and more particularly to a door closure which may hold a door in a fully opened position.

In many buildings, screen doors or storm doors and the like are mounted outside the primary doors of the structure. Such doors almost always will not stay open unless held open by the user or the door closer is latched in the open position. Usually, a torsion or compression spring is used to immediately return and close such auxiliary door after it has been released by the user.

In many cases, however, it is desirable that the auxiliary door be left open when the user is going back and forth, has both arms occupied, or when the user is not ambulatory as in a wheelchair.

U.S. Pat. No. 3,538,537 discloses a combination door release and door check. This invention is considered an improvement over the device shown in that patent.

The present invention provides a door closer of simplified construction having a totally internal mechanism which will permit the user to open the door to a point where the internal mechanism will latch the door in an open position, and hold it there until the latch is released by small opening pressure on the door.

The present invention further provides a door closer of the type described where the latching member is completely internal of the device, and the latching mechanism is not likely to be affected by the elements.

Briefly stated, the invention in one form thereof is embodied in a cylinder-piston assembly where the piston rod is pivotally mounted to one of a door or a door frame and the cylinder is mounted to the other. As the door is opened, the piston extends from the cylinder and as the door is released, if not acted upon by the internal holding device, it will be returned by a spring against the dashpot effect of the piston in the cylinder. Disposed internally of the cylinder with the piston passing therethrough is a latching member. Rotatably mounted to the piston shaft is a latch which is normally in an inoperative position. However, when the door is opened a sufficient amount, the latch will strike a wall of the latching member and be rotated to a position where a lug or cam thereon will engage a wall of the latching member and prevent retraction of the piston in the cylinder. To permit the door to close, it is opened slightly from the latched open position until a cam on the latch strikes the front wall of the latching member, further rotating the latch to a position where it will be ineffective to latch to the latching member. This arrangement may be reversed as hereinafter described.

An object of this invention is to provide a door closer having new and improved means for holding a door in an open position.

The features of the invention which are believed to be novel are particularly pointed out and distinctly claimed in the concluding portion of this specification. The invention, however, both as to its organization and operation together with further objects and advantages thereof may best be appreciated by reference to the following detailed description taken in conjunction with the drawings, wherein:

Figures 1, 2, 3:
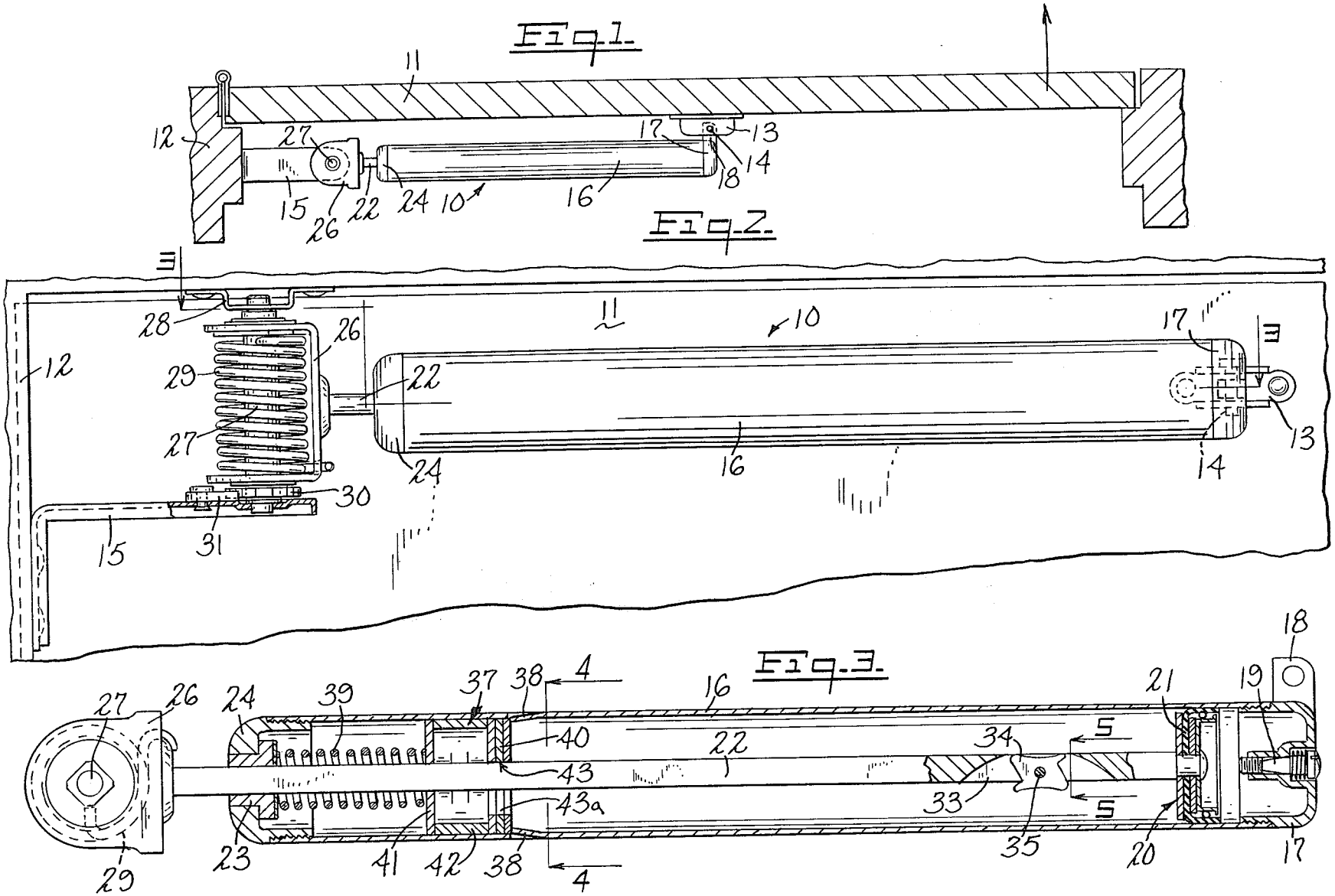
FIG. 1 is a top view showing a device embodying the invention mounted to a door in a door jamb.
FIG. 2 is an enlarged view of the device of FIG. 1 in elevation.
FIG. 3 is a view seen in the plane of lines 3—3 of FIG. 2.
Figure 11:
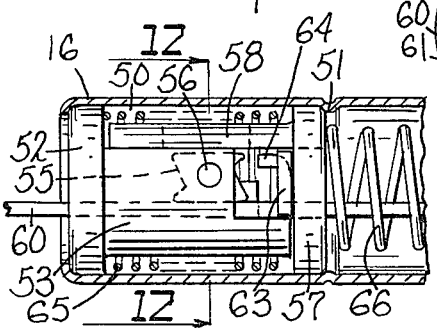
Figure 12:
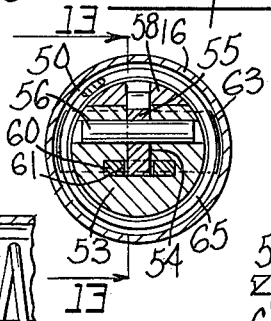
Figure 13:
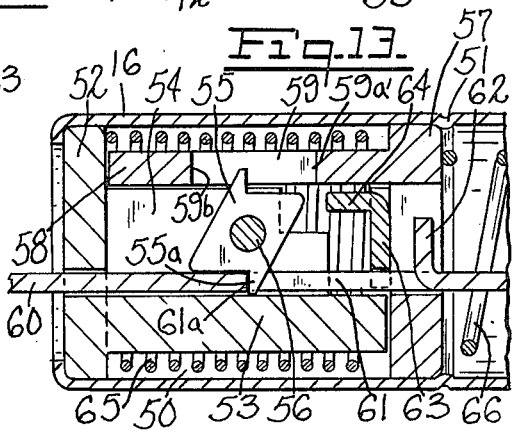

FIGS. 7, 8, 9, and 10 are enlarged views of a portion of the mechanism shown in FIG. 3, and are illustrative of the operation of the device;

FIG. 11 is a side view, with elements partially cut away showing another form of the invention;

FIG. 12 is a sectional view seen in the plane of lines 12—12 of FIG. 11; and FIG. 13 is a sectional view seen in the plane of lines 13—13 of FIG. 12.

A first device 10 embodying the invention is shown as pivotally mounted to a door 11 and to a door jamb or frame 12. The door closer is pivoted to a bracket 13 on door 11 by a pin 14, and to a door jamb bracket 15.

The device 10 comprises a hollow cylinder member 16 having an end closure 17 with a mounting flange 18 extending therefrom. End closure 17 is threadably received in cylinder 16 and carries a bleed valve 19 which may be adjusted to vary the dashpot effect. A piston 20 comprises a head or cup 21 of flexible material which is slidable in on the interior surfaces of cylinder 16, and a rod 22 which extends through a bearing 23 carried in end closure member 24, threadably received in cylinder 16 at the other end. Bearing 23 may be a material such as nylon to facilitate sliding of rod 22 (FIG. 2). Piston rod 22 is connected to a generally U-shaped bracket 26 which is mounted to and pivotal about a shaft 27. Shaft 27 is carried between jamb brackets 15 and 28. A torsion spring 29 has one end received in shaft 27 and the other end connected to bracket 26. When the door is opened, spring 29 will be stressed and store energy therein to return the door 10 to a closed position when the door is released by the user.

Carried on shaft 27 is a ratchet 30, and pivoted to bracket 15 is a pawl 31 cooperating with ratchet 30. Shaft 27 may be angularly adjusted and held in a given position by ratchet 30 and pawl 31 to prestress spring 29.

Figure 4:
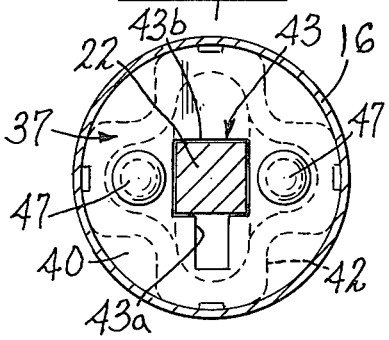
FIG. 4 is a view seen in the plane of lines 4—4 of FIG. 3.

A slot 33 is longitudinally defined in piston rod 22. Rod 22, as shown in FIG. 4, is of square cross-section. A latch 34 is pivoted to rod 22 within slot 33 by a pin 35 extending through rod 22 and latch 34. A spring washer 36 is disposed between latch 34 and one wall of slot 33 (FIG. 5) so that latch 34 will only pivot or rotate when acted upon as hereinafter described. Disposed within cylinder 16 is a latch actuating member 37. Member 37 is positioned in a compartment defined by a plurality of inwardly directed lugs or tabs 38 struck from the wall of cylinder 16. A spring 39 resiliently biases member 37 into contact with tabs 38. Actuating member 37 comprises a front wall portion 40, a rear wall portion 41, and a spacer 42 between the wall portions. An aperture 43 is defined in front wall 40 to receive rod 22. Aperture 43 is elongated below the position of rod 22, as indicated at 43*a*, to define a substantially T-shaped opening to permit latch 34 to pass therethrough. It will be noted that the upper edge of latch 34, as seen in FIG. 3, does not normally extend above rod 22.

Front wall 40 may be comprised of three similar laminations having the substantially T-shaped opening 43*a* therein. The back wall 41 is a plate having an opening therethrough which permits only the piston rod 22 to move therethrough. Spacer member 42 has sufficient internal clearance to permit rotation of latch 34 therein and spaces the front and back walls 40 and 41 for the same purpose. Latch actuating member 37 is held together in compression by means of rivets 47 (FIG. 4) extending through the assembly. The member 37 provides not only a latch actuating means as provided by wall 41, but a latch engaging means provided by edge 43*b* and a latch engaging member provided by wall 40 as hereinafter explained.

Figure 6:
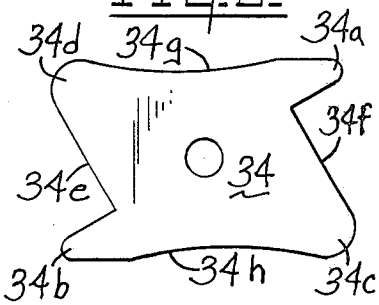
FIG. 6 is an enlarged view of the latch shown in FIG. 3.
Figure 7:
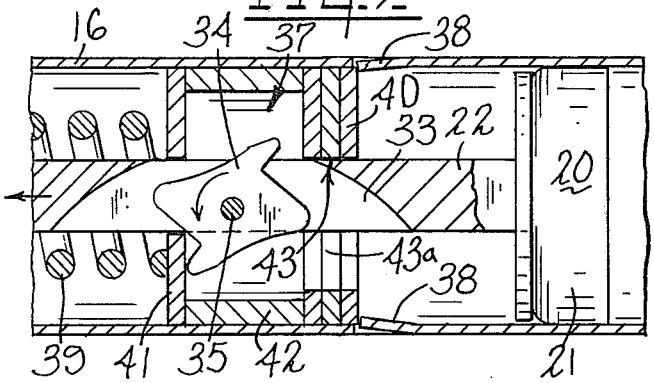
Figure 8:
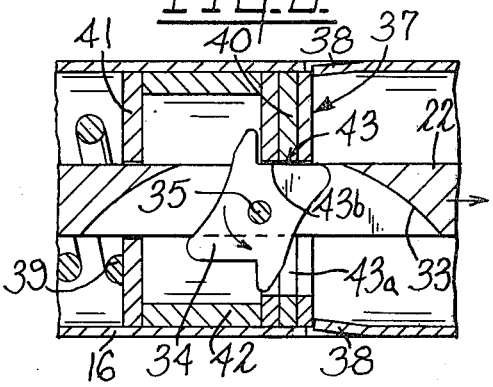
Figure 9:
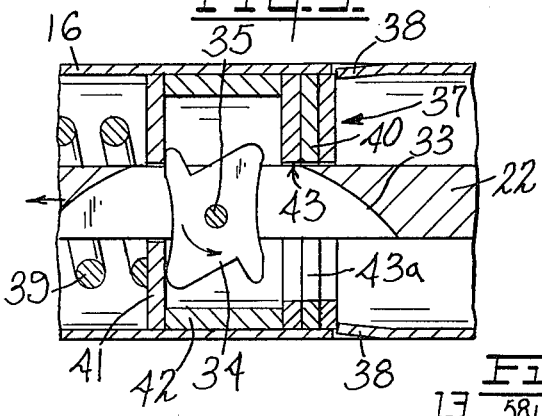

Reference is now made to FIG. 6, in conjunction with FIG. 3. Latch 34 has two latching lugs 34*a* and 34*b*, and two cam edges 34*c* and 34*d* with substantially linear edges 34*e* and 34*f* extending from a lug to a cam edge. Latch 34 extends below rod 22, but not above. The latch may pass through the opening 43*a* is front wall 40 but not wall 41.

Reference is now made to FIGS. 7–10 for an explanation of the operation of the device. As door 10 is opened, piston rod 22 extends from cylinder 16. If the door is opened a sufficient distance to the position shown in FIG. 7, lug 34*b* will strike rear wall 41 and latch 34 will be actuated and rotated as shown. Wall 41 is responsive to predetermined extension of the piston rod to pivot or rotate the latch. Then, when the opening force on the door 10 is released, spring 29 will tend to close the door driving piston rod 22 back into cylinder 16. As the door commences to close, lug 34*a* engages front wall 40 and surface 34*f* of latch 34 will engage edge 43*b* of opening 43. This engagement will prevent further rotation of latch 34 and maintain the piston rod 22 in given relation to cylinder 16, thus holding the door open.

Figure 10:
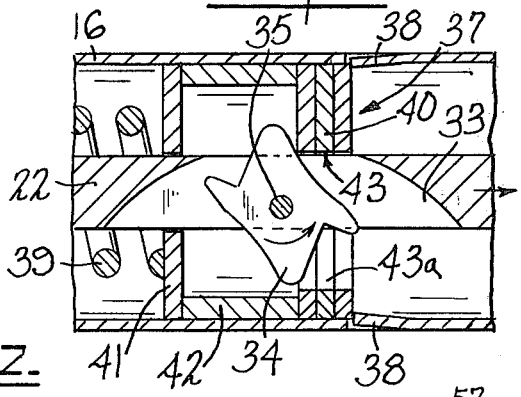

When it is desired to allow the door to close, the door is pushed slightly towards the open position to further extend rod 22. At this time, cam edge 34*d* of latch 34 will engage rear wall 41 and be rotated to the position shown in FIG. 9. Thereafter, as the manual force on the door is released, the door will start to close by virtue of spring 29, cam edge 34*c* will engage the rear of front wall 40 and be rotated as shown in FIG. 10. As it rides under edge 43*b* of opening 43, it will be rotated 180° from the position shown in FIG. 3. It will be noted that the latch 34 is so formed that it will again repeat the foregoing cycle of operation even though on the next cycle it will start from a position 180° from its previous position.

The opening 43 and 43*a* in the front wall is of sufficient depth that the latch may pass therethrough upon an initial door opening and also to permit rotation of the latch when the door is moving to a closing position as shown in FIG. 10. Edges 34*g* and 34*h* of the latch may be contoured, as shown, on a large radius so that when such edges are engaged as shown in FIG. 10, the latch may be easily rotated by the engaging corner.

The invention may also be embodied in a substantially reversed configuration. As shown in FIGS. 11–13, cylinder 16 has a compartment 50 defined at the piston rod end thereof by an annular inward crimp 51. Within compartment 50 is an annular member 52 having a partially cylindrical extension 53. Extension 53 has a longitudinal slot 54 defined therein and a latch 55 is pivotally mounted therein by a pin 56 extending between the walls defining slot 54. A second annular member 57 in compartment 50 has an extension 58 toward member 52. An aperture 59 is defined therein by end walls 59*a* and 59*b* to permit rotation of latch 55. Member 57 with aperture 59 defined therein is a latch engaging member.

The piston rod 60 is retangular in cross section and has a slot opening 61 defined therein, and an adjacent upstanding tab 62. A plate member 63 extends across member 57 and has an extending latch actuating finger 64. A spring 65 acts to bias members 52 and plate 63 apart.

In operation, as piston rod 60 is extended as the door is opened, tab 62 will engage plate member 63 and move it to the left, and finger 64 will rotate latch 55 as opening 61 passes thereunder. Thus, plate 63 and finger 64 is a latch actuating member responsive to extension of rod 60 a predetermined length.

As the door is released, lug 55*a* engages the edge 61*a* of piston rod 60 and latches the rod against further retraction, thus holding the door open. When the door is to be closed, the rod is once again extended, tab 62 engages plate 63, and pushes finger 64 into contact with latch 55. As the rod is extended, opening 61 therein moves under latch 55 and permits it to rotate to the position shown in FIG. 11. Then, upon release of the door, an internal closure spring 66 acting on the piston head (not shown) retracts the piston rod, and closes the door.

Figure 5:
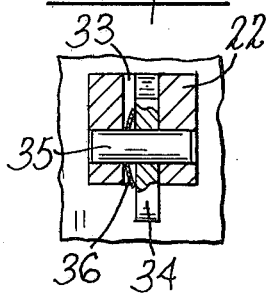
FIG. 5 is a view seen in the plane of lines 5—5 of FIG. 3.

While not shown, a spring washer may be disposed about pin 56 to prevent undesired pivotal or rotational movement of the latch in the same manner as previously shown in FIG. 5.

It may thus be seen that the objects of the invention set forth as well as those made apparent from the foregoing description are efficiently attained. While preferred embodiments of the invention have been set forth for purposes of disclosure, modification to the disclosed embodiments of the invention as well as other embodiments thereof may occur to those skilled in the art. Accordingly, the appended claims are intended to cover all embodiments of the invention and modifications to the disclosed embodiments which do not depart from the spirit and scope of the invention.

What is claimed is:

1. A door closer of the dashpot type comprising a piston having a rod and a cylinder each adapted to be pivotally mounted to one of a door and a door frame, a latch adapted to hold the rod of said piston in an extended position when the door is opened, a latch engaging member enclosed within said cylinder and having an opening therein, said piston rod extending through said opening of said latch engaging member in said cylinder, means pivotally mounting said latch to said piston rod, latch actuating means reponsive to predetermined extension of said piston rod for pivoting said latch into a position of engagement with said latch engaging member and thereby preventing retraction of said piston rod, said latch actuating means being effective to further pivot said latch to a disengaging position upon further extension of said piston rod.

2. The door closer of claim 1, further including resilient means for restraining pivotal movement of said latch unless it is acted upon by said latch actuating means.

3. The door closer of claim 1 where said rod has a longitudinal slot therein, and said latch is pivotally mounted to said rod in said slot.

4. The door closer of claim 3, further including resilient means in contact with said latch in said slot for preventing pivotal movement of said latch unless it is actuated upon by said latch engaging means.

5. A door closer according to claim 1 where said latch engaging member and said latch actuating means comprise spaced apart first and second walls, respectively, said first wall defining said opening of a size sufficient for the rod and said latch to pass therethrough, said second wall being said latch actuating means and having an opening for the rod therethrough, said latch having latching lugs and camming edges to engage said second wall and rotate said latch to a position where a lug engages the first wall and prevents retraction of said piston rod in said cylinder, said second wall serving to rotate said latch upon reengagement of a camming edge to a position where a lug will not engage said first wall and the piston may be retracted in the cylinder.

6. The device of claim 5 where said latch engaging member is resiliently positioned in said cylinder against tabs struck inwardly from the wall of said cylinder.

7. The device of claim 5 where said latch engaging member and said latch actuating means comprises an assembly of said first and second walls with a spacing member therebetween, and a spring is disposed between the piston rod end of the cylinder and said second wall.

8. A door closer according to claim 5 further including means for restraining pivotal movement of said latch unless it is acted upon by said latch actuating means.

* * * * *